US008933843B2

(12) United States Patent
Pan et al.

(10) Patent No.: US 8,933,843 B2
(45) Date of Patent: Jan. 13, 2015

(54) DUAL-BAND ANTENNA AND COMMUNICATION DEVICE USING THE SAME

(75) Inventors: Bo Pan, Irvine, CA (US); Ching-Wei Ling, Xinhua Township (TW)

(73) Assignee: Realtek Semiconductor Corp., Hsinchu (TW)

( * ) Notice: Subject to any disclaimer, the term of this patent is extended or adjusted under 35 U.S.C. 154(b) by 809 days.

(21) Appl. No.: 12/957,702

(22) Filed: Dec. 1, 2010

(65) Prior Publication Data

US 2012/0139792 A1 Jun. 7, 2012

(51) Int. Cl.
*H01Q 1/24* (2006.01)
*H01Q 5/00* (2006.01)
*H01Q 9/04* (2006.01)

(52) U.S. Cl.
CPC ..... *H01Q 1/243* (2013.01); *H01Q 5/0051* (2013.01); *H01Q 9/0471* (2013.01)
USPC ..... 343/702; 343/828

(58) Field of Classification Search
USPC ..... 343/702, 741, 825, 826, 828, 829, 343/700 MS
See application file for complete search history.

(56) References Cited

U.S. PATENT DOCUMENTS 6,714,162 B1 3/2004 Kadambi et al.
7,518,561 B2 4/2009 Mei
8,421,688 B2 * 4/2013 Tu ..... 343/702
8,502,748 B2 * 8/2013 Liang et al. ..... 343/860

FOREIGN PATENT DOCUMENTS

CA 1877910 A 12/2006

* cited by examiner

*Primary Examiner* — Michael C Wimer
(74) *Attorney, Agent, or Firm* — Birch, Stewart, Kolasch & Birch, LLP

(57) ABSTRACT

A dual-band antenna is disclosed, comprising a radiating body, a shorting element, and a feeding element. The radiating body comprises a plurality of radiating portions located in a first, a second, a third, and a fourth planes, respectively. The shorting element and the feeding element both extend from the radiating body and are located in the first plane. The radiating portions located in the first, the second, and the third planes transmit and/or receive signals in a first frequency band. The radiating portions located in the first, the second, and the fourth planes transmit and/or receive signals in a second frequency band. A first angle between the first and the second planes, a second angle between the second and the third planes, and a third angle between the second and the fourth planes range between 80 degrees to 100 degrees.

19 Claims, 9 Drawing Sheets

DUAL-BAND ANTENNA AND COMMUNICATION DEVICE USING THE SAME

BACKGROUND

The present disclosure generally relates to an antenna, and more particularly, to a dual-band antenna utilized in a wireless communication device.

Electronic devices with compact dimensions and powerful functionalities have been widely accepted by the consumers. As the dimensions of the electronics devices keep shrinking, many internal and external components should be redesigned to fit in the limited space.

Many electronic devices support transceiving (i.e., transmitting and/or receiving) radio signals in multiple frequency bands, for example, IEEE 802.11n compatible devices, IEEE 802.11a/b/g compatible devices, devices supporting multiple communication standards (e.g., GSM, 3G, 4G, Bluetooth, IEEE 802.11 series, IEEE 802.16 series, etc.), or other devices capable of transceiving radio signals in multiple frequency bands. These devices are equipped with multiple antennas for transceiving radio signals in several frequency bands.

The dimensions occupied by the antennas are, therefore, one of the challenges when downsizing the electronic devices.

SUMMARY

In view of the foregoing, it is appreciated that a substantial need exists for the compact-sized, low-cost, and multiple-band transceiving antennas to mitigate the problems mentioned above.

An example embodiment of a dual-band antenna comprises a radiating body, comprising a plurality of radiating portions located in a first, a second, a third, and a fourth planes, respectively; a shorting element extending from the radiating body and located in the first plane; and a feeding element extending from the radiating body and located in the first plane; wherein the radiating portions located in the first, the second, and the third planes transmit and/or receive signals in a first frequency band; the radiating portions located in the first, the second, and the fourth planes transmit and/or receive signals in a second frequency band; and a first angle between the first and the second planes, a second angle between the second and the third planes, and a third angle between the second and the fourth planes range between 80 degrees to 100 degrees.

An example embodiment of a wireless communication device comprises a substrate, comprising a first connecting element and a second connecting element; and a dual-band antenna, comprising a radiating body, comprising a plurality of radiating portions located in a first, a second, a third, and a fourth planes, respectively; a shorting element extending from the radiating body, located in the first plane, and coupled to the first connecting element; and a feeding element extending from the radiating body, located in the first plane, and coupled to the second connecting element; wherein the radiating portions located in the first, the second, and the third planes transmit and/or receive signals in a first frequency band; the radiating portions located in the first, the second, and the fourth planes transmit and/or receive signals in a second frequency band; and a first angle between the first and the second planes, a second angle between the second and the third planes, and a third angle between the second and the fourth planes range between 80 degrees to 100 degrees.

It is understood that both the foregoing general description and the following detailed description are exemplary and explanatory only and are not restrictive of the invention, as claimed.

DETAILED DESCRIPTION

Reference will be made in detail to exemplary embodiments of the disclosure, which are illustrated in the accompanying drawings. The same reference numbers may be used throughout the drawings to refer to the same or like parts or operations.

Certain terms are used throughout the description and following claims to refer to particular components. As one skilled in the art will appreciate, a component may be referred to as different names. This disclosure does not intend to distinguish between components that differ in name but not in function. In the following description and in the claims, the terms "include" and "comprise" are used in an open-ended fashion, and thus should be interpreted to mean "include, but not limited to . . . " The phrase "coupled to" is intended to compass any indirect or direct connection. Accordingly, if this disclosure mentioned that a first device is coupled to a second device, it means that the first device may be directly or indirectly connected to the second device through an electrical connection, wireless communications, optical communications, or other signal connections with/without other intermediate device or connection means.

Figure 1:
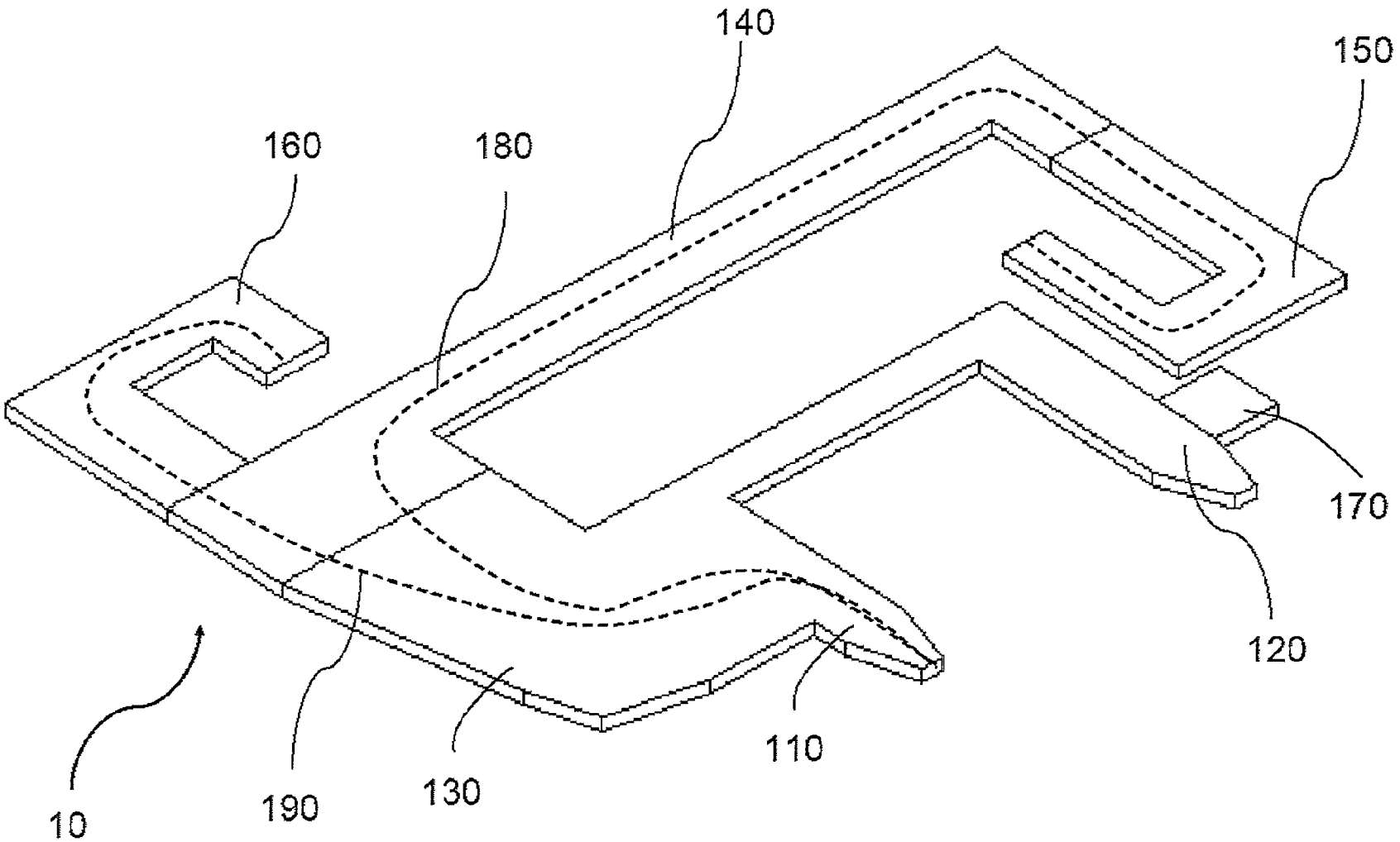
FIG. 1 shows a perspective view of an example dual-band antenna.

FIG. 1 shows a perspective view of an example dual-band antenna 10. The antenna 10 comprises a radiating body, a feeding element 110, a shorting element 120, and a supporting element 170. The feeding element 110, the shorting element 120, and the supporting element 170 extend from the radiating body. In this embodiment, the radiating body of the antenna 10 comprises radiating portions 130, 140, 150, and 160. The antenna 10 can be regarded as a combination of two inverted-F antennas. The virtual paths 180 and 190 represent the equivalent current paths in a first frequency band and a second frequency band of the antenna 10, respectively.

In the embodiment in FIG. 1, the feeding element 110 and the shorting element 120 are tapered toward the terminal of each element. When the antenna 10 is affixed to a substrate (not shown), the dimensions of the feeding element 110 and the shorting element 120, or the dimensions of the corresponding connecting elements on the substrate can be adjusted so that the antenna 10 and the substrate can be kept at a predetermined distance. In other embodiments, the shapes of the feeding element 110 and the shorting element 120 can be ladder-shaped, curved, or other geometric patterns for keeping the antenna 10 and the substrate at the predetermined distance. In another embodiment, the feeding element 110 and the shorting element 120 have constant widths and are used in combination with other component(s), e.g., the supporting element 170 or other supporting components, for keeping the antenna 10 and the substrate at the predetermined distance.

The supporting element 170 is configured at one side of the shorting element 120. When the antenna 10 and the substrate are affixed, the supporting element 170 along or in combination with the feeding element 110 and/or the shorting element 120 can be used to keep to the antenna 10 and the substrate at the predetermined distance. The supporting element 170 can also enhance the structural stability when the antenna 10 and the substrate are affixed. In other embodiments, the supporting element 170 can be configured on the other side of the shorting element 120 or one side of the feeding element 110. In yet another embodiment, there are multiple supporting elements configured on the feeding element 110 and/or the shorting element 120. In still another embodiment, there is no supporting element configured on the antenna 10.

The antenna 10 receives signals from other components (not shown) through the feeding element 110 and the shorting element 120. The signals are transmitted through the radiating portions 130, 140, 150, and 160. Radio signals can also be received through the radiating portions 130, 140, 150, and 160. The received radio signals are transmitted to other components (not shown) through the feeding element 110 and the shorting element 120.

In the embodiment in FIG. 1, the radiating portion 130 is tapered in the direction from the radiating portion 140 toward the feeding element 110. In other embodiments, the width of the radiating portion 130 is widened in the direction from the radiating portion 140 toward the feeding element 110. The radiating portion 130 can be multi-segmented, linearly varied, curved, or other geometric patterns. In another embodiment, the radiating portion 130 has a constant width.

The virtual path 180 routes through the radiating portions 130, 140, and 150. The length of the virtual path 180 is the equivalent current path of the antenna 10 in the first frequency band and substantially equals to ¼ wavelength of the radio signals in the first frequency band. The length of the equivalent current path of the antenna 10 in the first frequency band can therefore be configured by adjusted the dimensions of the radiating portions 130, 140, and/or 150.

The virtual path 190 routes through the radiating portions 130, 140, and 160. The length of the virtual path 190 is the equivalent current path of the antenna 10 in the second frequency band and substantially equals to ¼ wavelength of the radio signals in the second frequency band. The length of the equivalent current path of the antenna 10 in the second frequency band can therefore be configured by adjusted the dimensions of the radiating portions 130, 140, and/or 160.

In some embodiments, only the dimensions of the radiating portion 150 are adjusted to configure the equivalent current path of the antenna 10 in the first frequency band, and only the dimensions of the radiating portion 160 are adjusted to configure the equivalent current path of the antenna 10 in the second frequency band. The equivalent current paths in these two frequency bands can therefore be independently configured.

The element and radiating portions of the antenna 10 can be separately fabricated with conductive materials and then assembled. The antenna 10 can also be made by properly stamping and cutting an integrally formed conducting sheet to reduce the manufacturing complexity and cost.

Before the antenna 10 is affixed to the substrate of the wireless communication device, the antenna can be bent into an appropriate form to increase the structural strength and stability.

Figure 2:
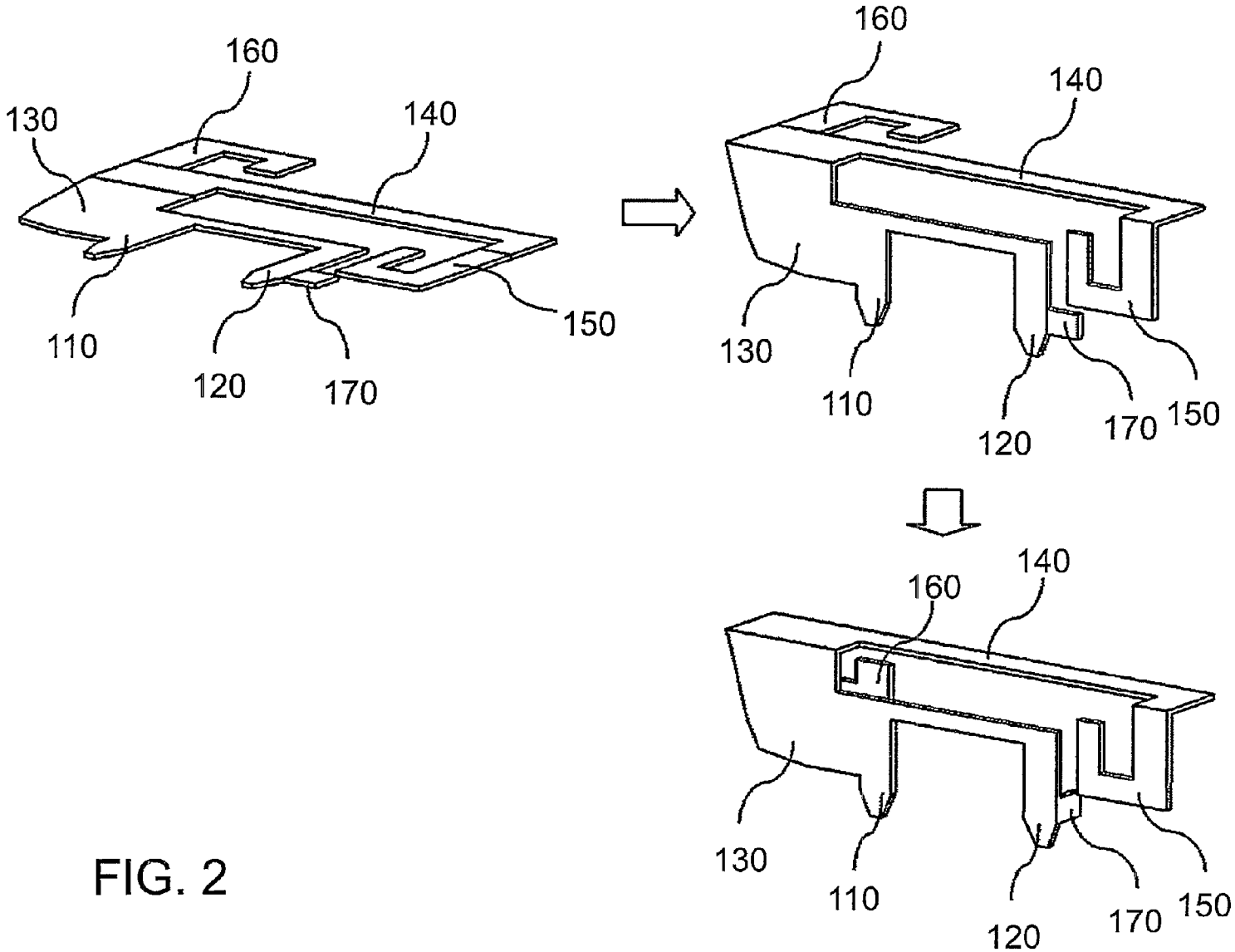
FIG. 2 shows an example flow of bending the dual-band antenna in FIG. 1.

FIG. 2 shows an example flow of bending the antenna 10 in FIG. 1. As shown in FIG. 2, the feeding element 110, the shorting element 120, the radiating portion 130, and the radiating portion 150 are bent and constitute a predetermined angle with the radiating portion 140. The radiating portion 160 is bent to a predetermined angle with regard to the radiating portion 140. Afterwards, the supporting element 170 is also bent to a predetermined angle with regard to the shorting element 120. The above angles can range, for example, from 80 degrees to 100 degrees. In this embodiment in FIG. 2, the angles are configured to be 90 degrees. In other embodiments, the order or the direction of bending the antenna 10 can be properly adjusted. In another embodiment, the supporting element 170 can be unbent. In still another embodiment, the antenna 10 can be bent in a mirror direction with respect to the embodiment in FIG. 2, e.g., the antenna 11 shown in FIGS. 4 and 5.

In this embodiment, the feeding element 110, the shorting element 120, the radiating element 130, and the radiating element 150 are configured in the same plane. In another embodiment, the radiating element 150 is not in the same plane of the feeding element 110, the shorting element 120, and the radiating element 130. In this embodiment, the radiating portion 160 is parallel to the feeding element 110, the shorting element 120, and the radiating element 130. In other embodiments, the radiating portion 160 is configured to be not parallel to the feeding element 110, the shorting element 120, and the radiating element 130.

In this embodiment, the radiating portion 140 is substantially perpendicular to the radiating portions 130, 150, and 160. The three-dimensional structure of the bent antenna 10 increases the structural strength and stability so that the antenna 10 does not easily deform during the assembly processing or in the normal operation.

Figure 3:
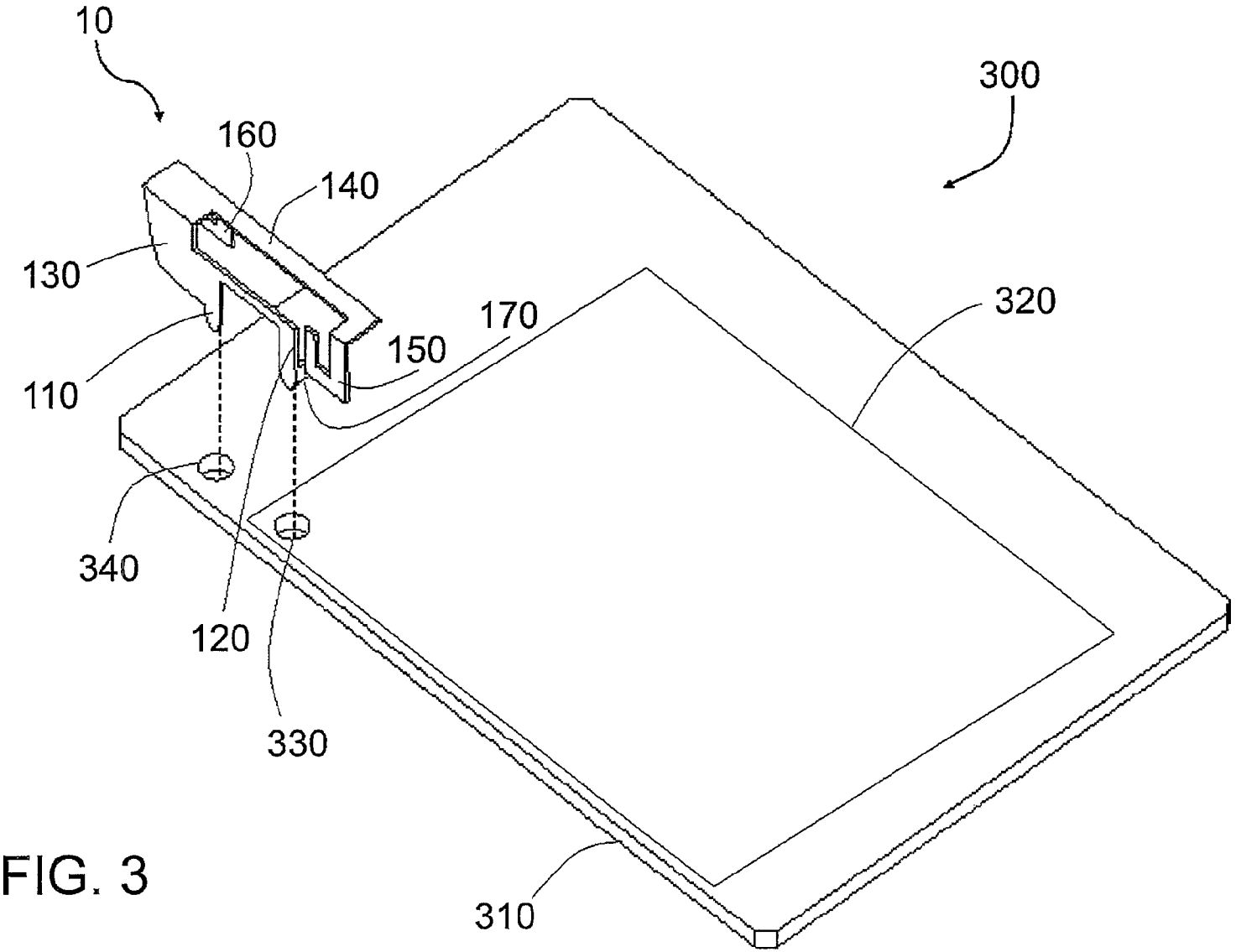
FIG. 3 shows a perspective view of an example wireless communication device equipped with one dual-band antenna in FIG. 1.

FIG. 3 shows a perspective view of an example wireless communication device 300. The wireless communication device 300 comprises an antenna 10 and a substrate 310. The substrate 310 comprises a grounding element 320 and connecting elements 330 and 340. The grounding element 320 in FIG. 3 is illustrative and not intended to be limited. The dimensions, the position, and the shape of the grounding element 320 can be adjusted according to different design considerations. Other components are omitted in FIG. 3 for conciseness.

The connecting elements 330 and 340 can be realized with through holes for affixing the antenna 10 on the substrate 310. In this embodiment, the connecting element 330 is a through hole and coupled to the grounding element 320 of the substrate 310. When the shorting element 120 is inserted into, soldered to, or, by other suitable means, connected to the connecting element 330, the shorting element 120 can be coupled to the grounding element 320. The connecting element 340 is also a through hole. The feeding element 110 can be inserted into, soldered to, or, by other suitable means, connected to the connecting element 340. The feeding element 110 can be coupled to other components for transceiving signals. In other embodiments, the connecting elements 330 and/or 340 can be realized with recesses, concaves, depressions, etc.

In the embodiment in FIG. 3, the feeding element 110 and the shorting element 120 are tapered and used in combination with the connecting elements 330 and 340 for keeping the antenna 10 and the substrate 310 at the predetermined distance.

When the antenna 10 is affixed to the substrate 310, the supporting element 170 can be configured to abut the surface of the substrate 310 or to separate the substrate 310 at a predetermined distance, e.g., less than 4 mm, for enhancing the structural stability of the antenna 10. In other embodiments, the supporting element 170 can be further processed. For example, a part of the supporting element 170 can be bent to parallel the surface of the substrate 310. When the antenna 10 is affixed to the substrate 310, the parallel part of the supporting element 170 abuts the surface of the substrate 310 to enhance the structural stability. In another embodiment, the supporting element 170 is not configured on the antenna 10 but on the substrate 310. In yet another example, the supporting element 170 is not configured on the antenna 10 but additional supporting components are used to affix the antenna 10 and the substrate 310. In still another embodiment, the supporting elements 170 or the supporting components are not utilized.

In this embodiment, when the antenna 10 is affixed to the substrate 310, the radiating portions 130, 150, and 160 are substantially perpendicular to the surface of the substrate 310, and the radiating portion 140 parallels the surface of the substrate 310. In other embodiments, the relative angles, the directions, and the positions of the radiating portions 130, 140, 150, and 160 of the antenna 10 and the substrate 310 can be properly adjusted.

Figure 4:
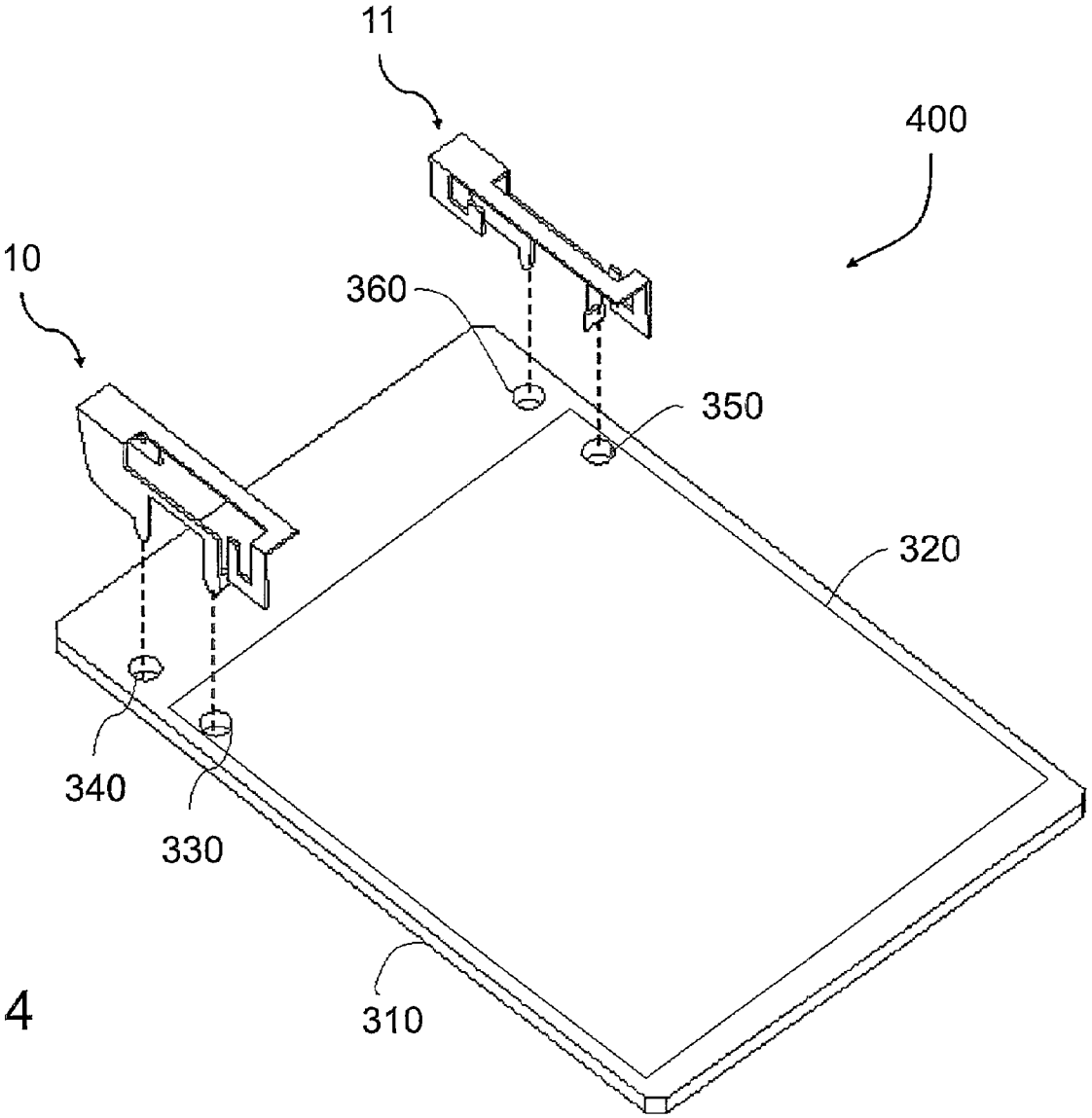
FIG. 4 shows a perspective view of another example wireless communication device equipped with two dual-band antennas in FIG. 1.
Figure 5:
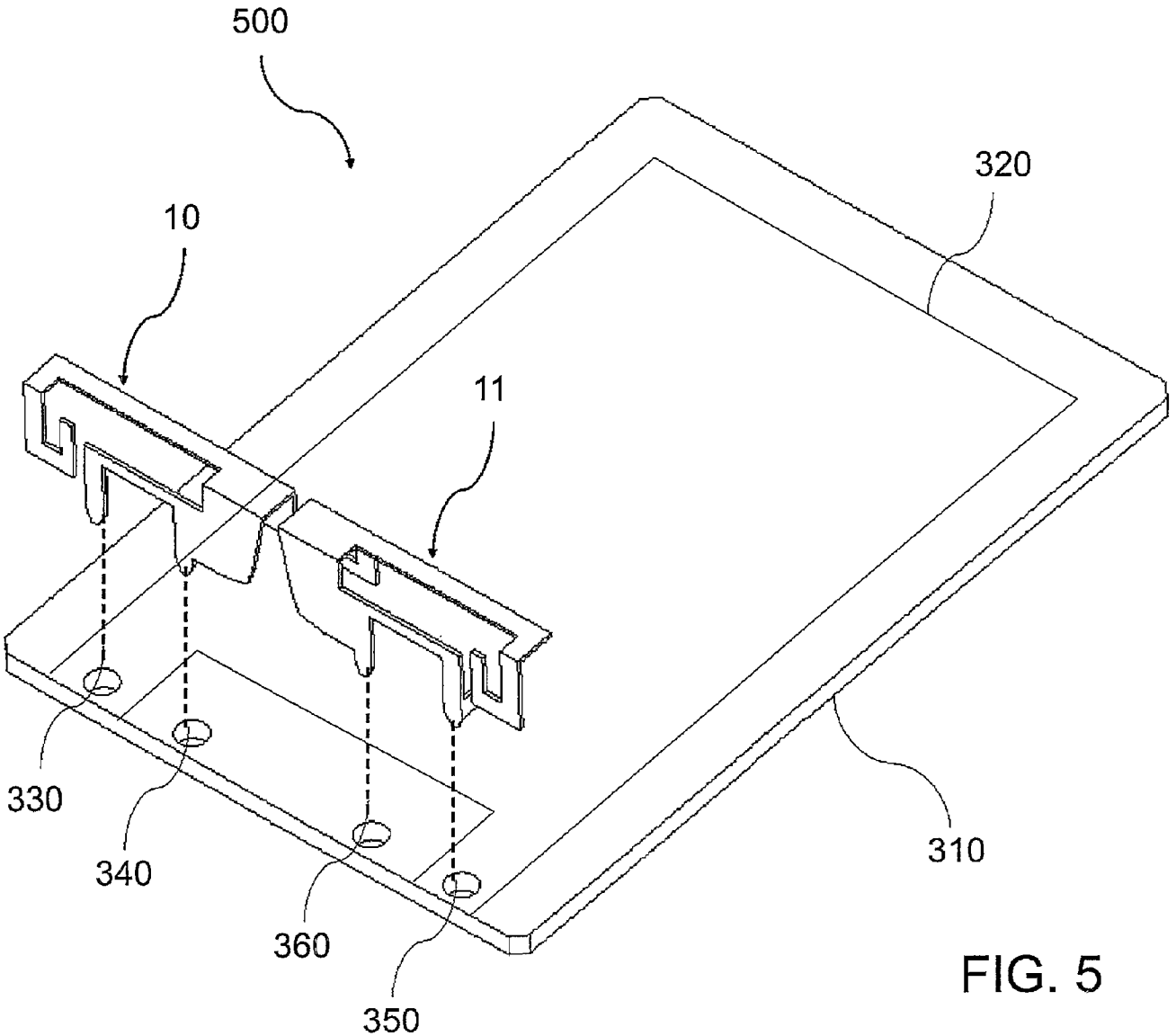
FIG. 5 shows a perspective view of yet another example wireless communication device equipped with two dual-band antennas in FIG. 1.

FIGS. 4 and 5 are perspective views of two example wireless communication devices 400 and 500, both equipped with two antennas 10 and 11. Wireless communication devices 400 and 500 both comprise a substrate 310 and two antennas 10 and 11. The substrate 310 comprises a grounding element 320 and connecting elements 330, 340, 350, and 360. The grounding elements 320 in FIGS. 4 and 5 are illustrative and not intended to be limited. The dimensions, the position, and the shape of the grounding element 320 can be adjusted according to different design considerations. Other components are omitted in FIGS. 4 and 5 for conciseness.

The connecting elements 330, 340, 350 and 360 can be realized with through holes for affixing the antennas 10 and 11 on the substrate 310. In this embodiment, the connecting elements 330 and 350 are through holes and coupled to the grounding element 320 of the substrate 310. When the shorting elements of the antennas 10 and 11 are inserted into, soldered to, or, by other suitable means, connected to the connecting elements 330 and 350, the shorting elements can be coupled to the grounding element 320. The connecting elements 340 and 360 are also through holes. The feeding elements of the antennas 10 and 11 can be inserted into, soldered to, or, by other suitable means, connected to the connecting elements 340 and 360. The feeding elements of the antennas 10 and 11 can be coupled to other components for transceiving signals. In other embodiments, the connecting elements 330, 340, 350, and/or 360 can be realized with recesses, concaves, depressions, etc. The dimensions of the feeding elements and the shorting elements, the supporting element(s), the supporting component(s), and the relative angles, the relative direction, and the relative position between the antennas and the substrate can also be properly adjusted along or in combination according to the above description.

In the embodiments in FIGS. 4 and 5, both of the antennas 10 and 11 are capable of transceiving signals in the first frequency band and the second frequency band. The wireless communication devices 400 and 500 therefore support the multiple-input-multiple-output (MIMO) function In another embodiment, the antenna 10 is configured to transceiver signals in the first frequency band and the second frequency band and the antenna 11 is configured to transceiver signals in the third frequency band and fourth frequency band. The wireless communication devices 400 and 500 therefore can transceiver signals in multiple designated frequency bands.

In other embodiments, the dimensions, the shapes, and the relative position of the elements of the antennas 10 and 11, the relative distances of the substrate 310 and the antennas 10 and 11 can be properly adjusted to obtain the required antenna characteristics. For example, in the embodiment in FIG. 6, the first frequency band of the antenna 10 is configured to be approximately 2.4 GHz and the second frequency band is configured to be approximately 5 GHz. The dimensions of the antenna 10 are configured to be approximately 20 mm×8 mm×3 mm, as shown in the figure.

Figure 6:
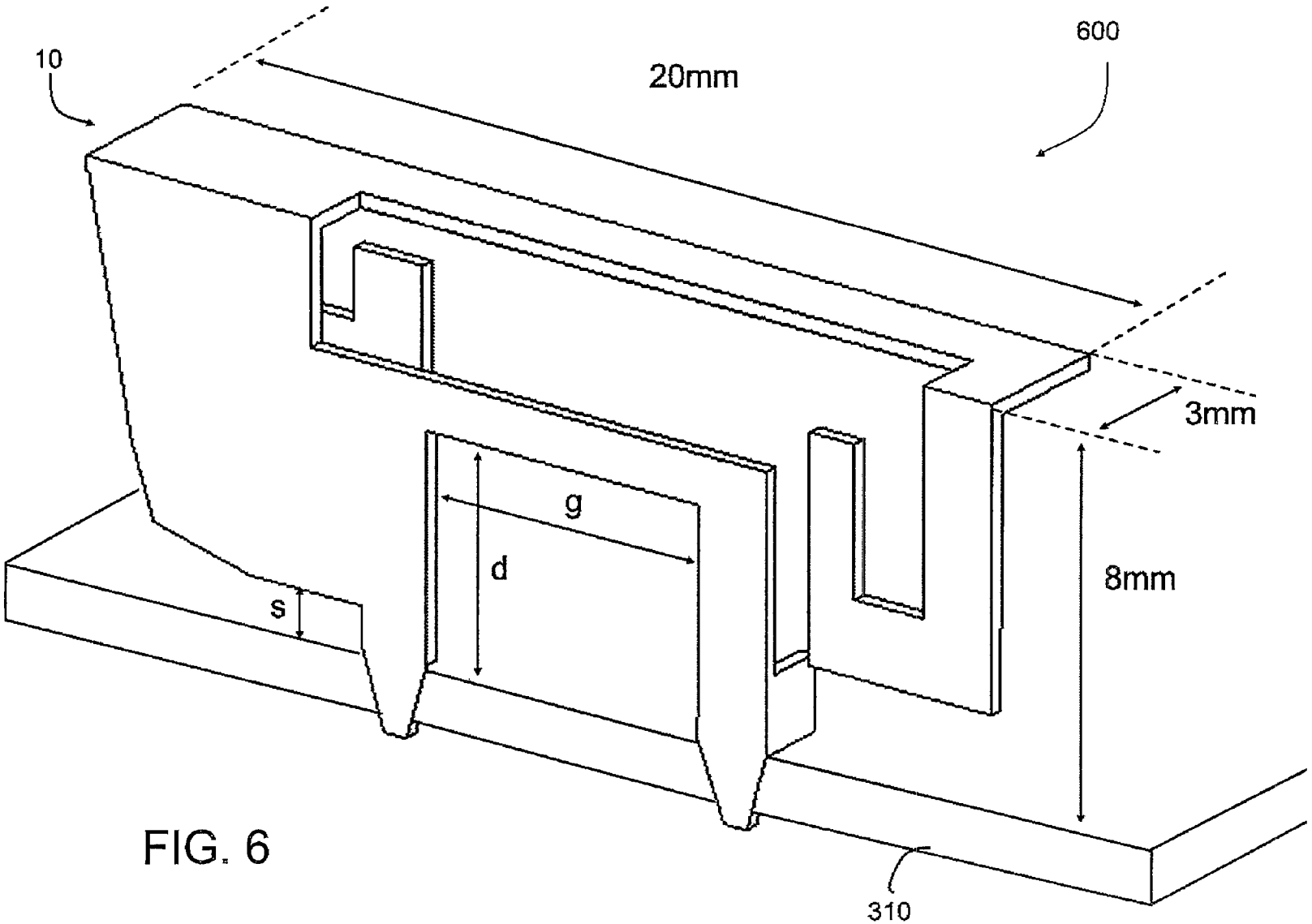
FIG. 6 shows a partial perspective view of still another example wireless communication device equipped with one dual-band antenna in FIG. 1.
Figure 7:
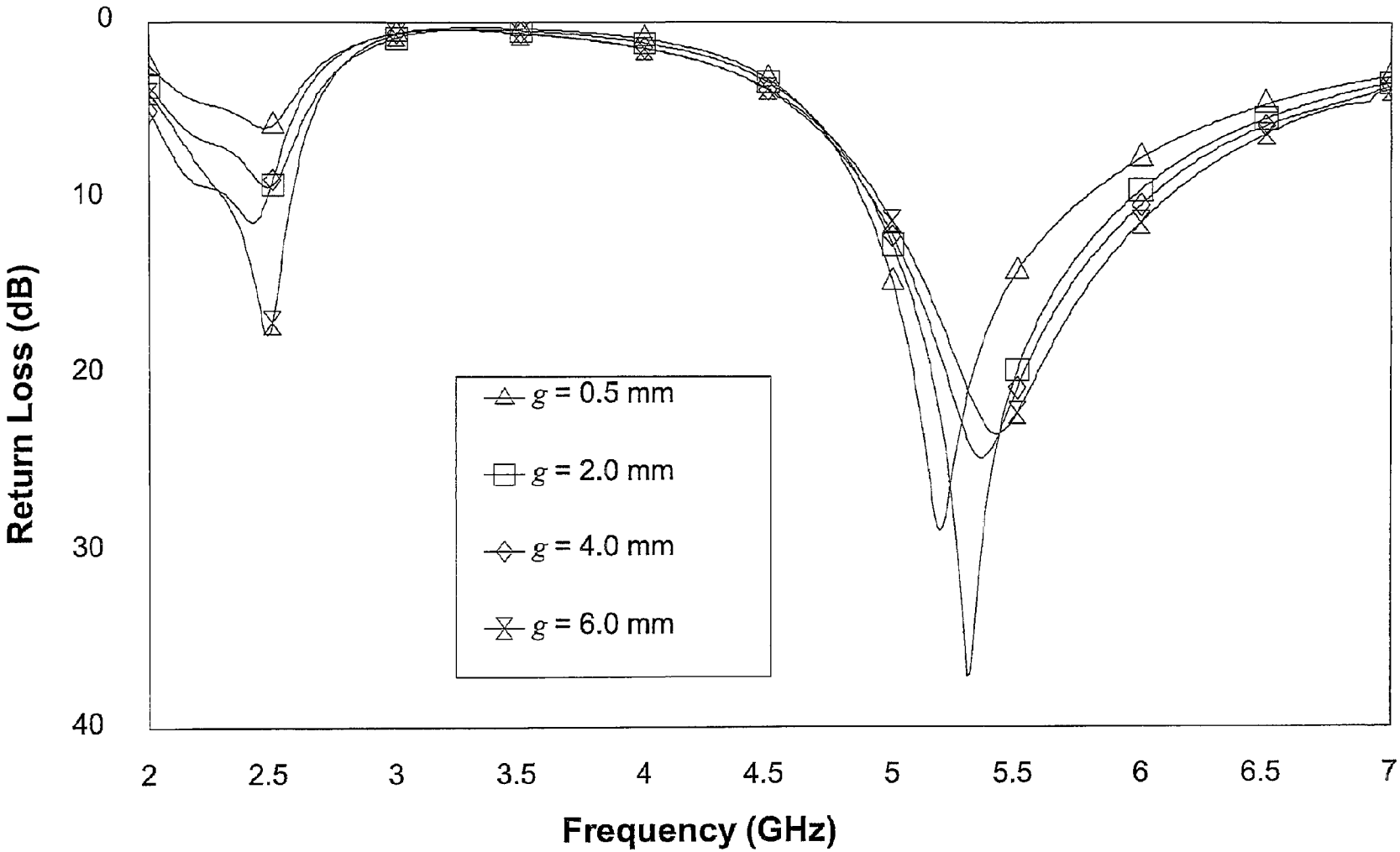
FIG. 7 shows several characteristic curves of the antenna in FIG. 6, each corresponds to the antenna configured with the specified distances between the feeding element and the shorting element.
Figure 8:
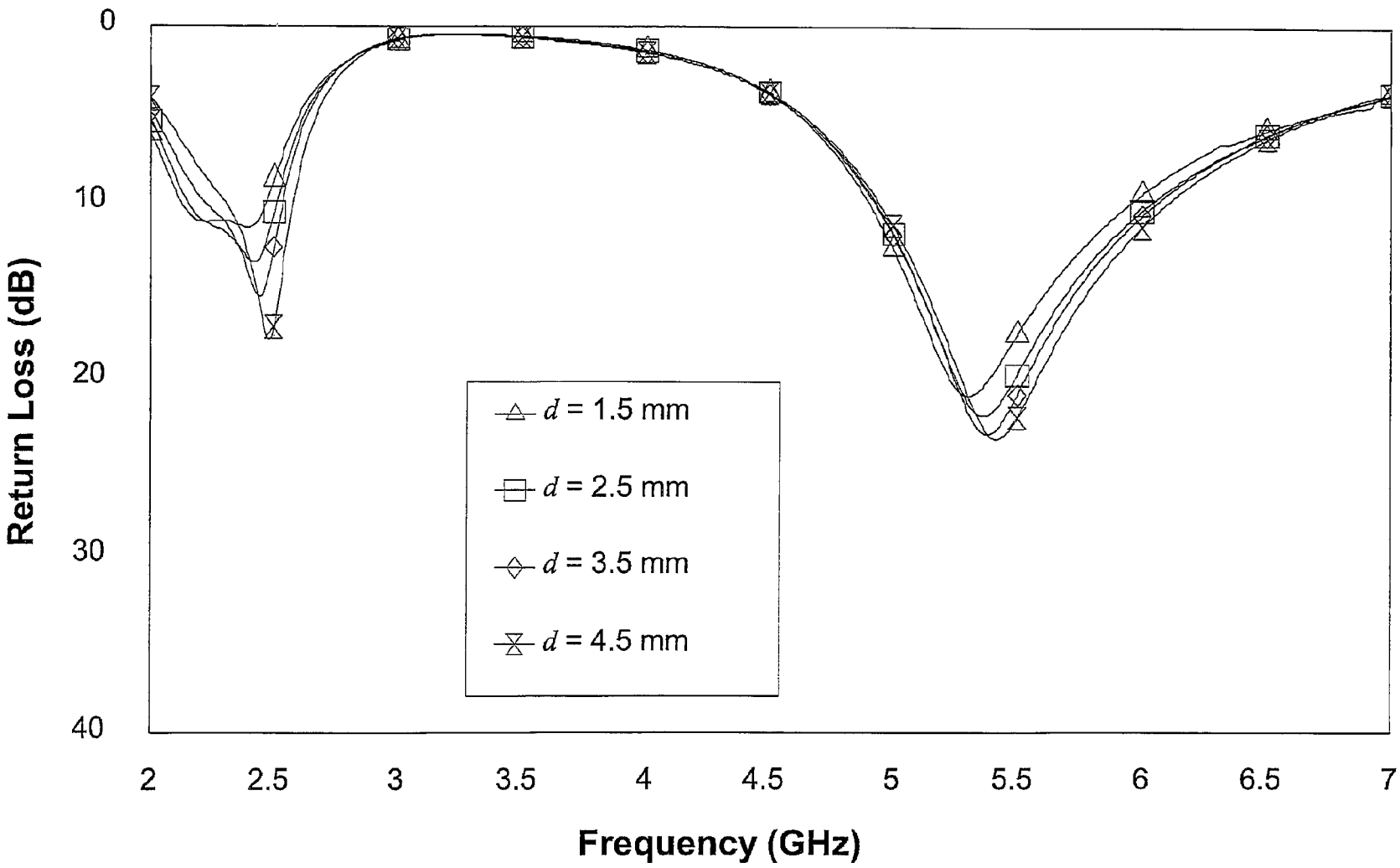
FIG. 8 shows several characteristic curves of the antenna in FIG. 6, each corresponds to the antenna configured with the specified distances between the shorting element and the substrate.
Figure 9:
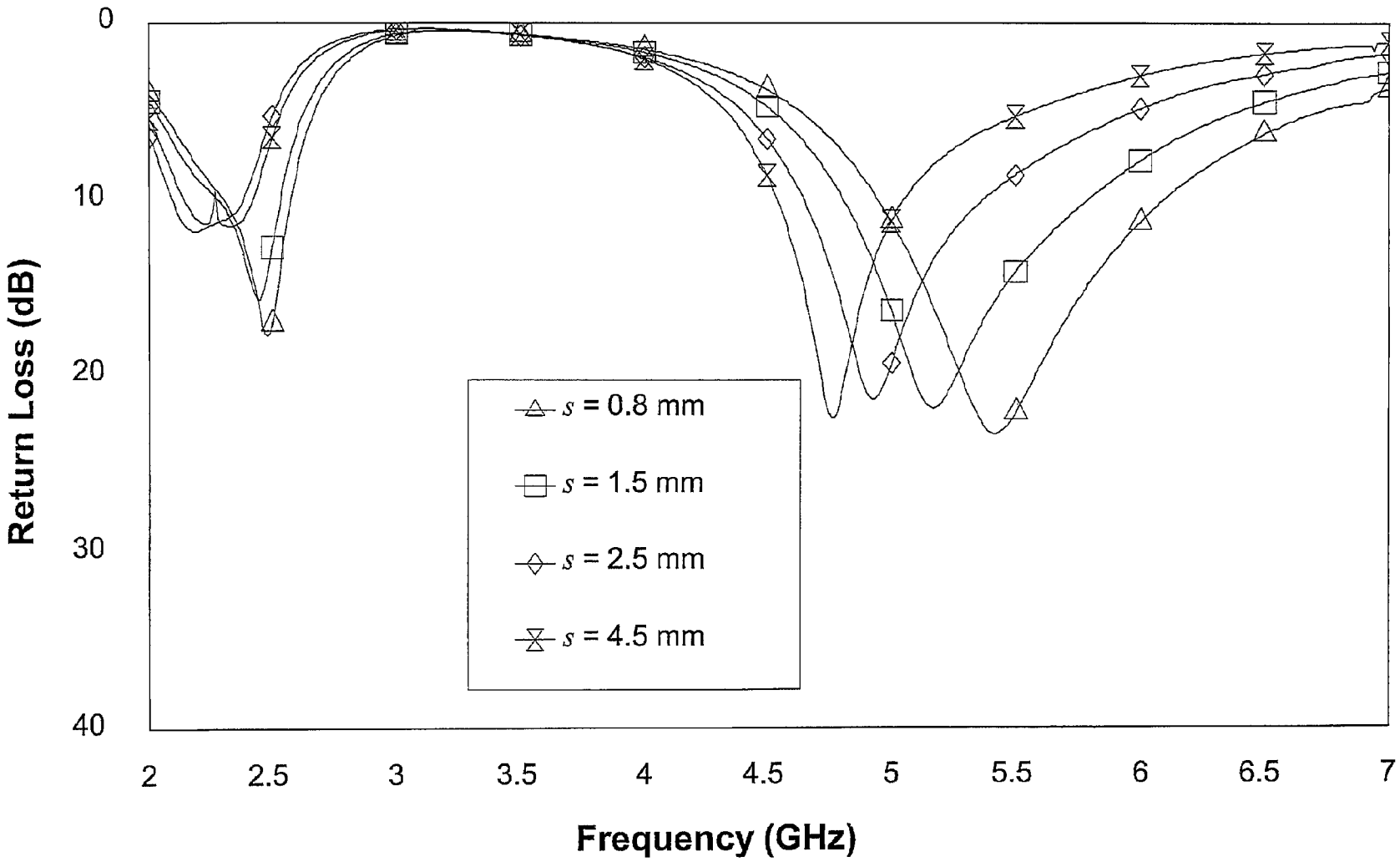
FIG. 9 shows several characteristic curves of the antenna in FIG. 6, each corresponds to the antenna configured with the specified distances between the radiating portion and the substrate, all arranged in accordance with at least some embodiments of the present disclosure described herein.

FIGS. 7-9 show several return loss characteristic curves of the antenna 10 in FIG. 6, each corresponds to the antenna 10 configured with different dimensions of the elements or parameters.

As shown in FIGS. 6 and 7, the return loss and the bandwidth in the required frequency band can be adjusted by configuring the distance g between the feeding element 110 and the shorting element 120 of the antenna 10. By adjusting the distance g, the input impedance can be changed accordingly to obtain the required impedance matching condition. The bandwidths and the return loss in the first frequency band and the second frequency band can therefore be adjusted and the required antenna characteristics are obtained. As the distance g increases, both the return loss in the first frequency band and the bandwidth in the second frequency band increase. For example, in the embodiment in FIG. 6, the distance g can be configured to range between 0.5 mm to 6 mm. In some preferred embodiments, the distance g can be configured to range between 4 mm to 6 mm.

As shown in FIGS. 6 and 8, the return loss and the bandwidth in the required frequency band can be adjusted by configuring the distance d between the shorting element 120 of the antenna 10 and the substrate 310. By adjusting the distance d, the input impedance can be changed accordingly to obtain the required impedance matching condition. The bandwidths and the return loss in the first frequency band and the second frequency band can therefore be adjusted and the required antenna characteristics are obtained. As the distance d increases, both the return loss in the first frequency band and the bandwidth in the second frequency band increase. For example, in the embodiment in FIG. 6, the distance d can be configured to range between 1.5 mm to 4.5 mm.

As shown in FIGS. 6 and 9, the return loss and the bandwidth in the required frequency band can be adjusted by configuring the distance s between the radiating portion 130 of the antenna 10 and the substrate 310. By adjusting the distance s, the input impedance can be changed accordingly to obtain the required impedance matching condition. The bandwidths and the return loss in the first frequency band and the second frequency band can therefore be adjusted and the required antenna characteristics are obtained. As the distance s decreases, both the return loss in the first frequency band and the bandwidth in the second frequency band increase. For example, in the embodiment in FIG. 6, the distance s can be configured to range between 0.8 mm to 4.5 mm. In some preferred embodiments, the distance s can be configured to range between 0.8 mm to 1.5 mm.

The aforementioned antennas can be made of an integrally formed structure by properly bending a conductive sheet. The antennas in this disclosure can be easily inserted into, soldered to, or, by other suitable means, connected to the substrate of the electronic device. The manufacture and the assembly of the antennas are simple and the cost can be reduced accordingly.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dual-band antenna, comprising:

a radiating body, comprising a plurality of radiating portions located in a first, a second, a third, and a fourth planes, respectively;

a shorting element extending from the radiating body and located in the first plane; and a feeding element extending from the radiating body and located in the first plane;

wherein the radiating portions located in the first, the second, and the third planes transmit and/or receive signals in a first frequency band; the radiating portion located in the third plane is utilized to adjust transmissions and/or receptions in the first frequency band; the radiating portions located in the first, the second, and the fourth planes transmit and/or receive signals in a second frequency band; the radiating portion located in the fourth plane is utilized to adjust transmissions and/or receptions in the second frequency band; a first angle between the first and the second planes, a second angle between the second and the third planes, and a third angle between the second and the fourth planes range between 80 degrees to 100 degrees; the third plane and the fourth plane are respectively located at two opposite ends of the second plane; and the third plane is arranged without overlapping both the first plane and the fourth plane.

2. The dual-band antenna of claim 1, further comprising one or more supporting elements extending from at least one of the radiating body, the shorting element, and the feeding element.

3. The dual-band antenna of claim 2, a fourth angle between the supporting element and at least one of the radiating body, the shorting element, and the feeding element ranges between 80 degrees to 100 degrees.

4. The dual-band antenna of claim 1, wherein the first plane and the third plane are substantially in the same plane.

5. The dual-band antenna of claim 1, wherein a distance between the shorting element and the feeding element ranges between 0.5 mm to 6 mm.

6. The dual-band antenna of claim 1, wherein the radiating body comprises:

a first radiating portion located in the first plane;

a second radiating portion located in the second plane;

a third radiating portion located in the third plane; and a fourth radiating portion located in the fourth plane.

7. A wireless communication device, comprising:

a substrate, comprising a first connecting element and a second connecting element; and a dual-band antenna, comprising:

a radiating body, comprising a plurality of radiating portions located in a first, a second, a third, and a fourth planes, respectively;

a shorting element extending from the radiating body, located in the first plane, and coupled to the first connecting element; and a feeding element extending from the radiating body, located in the first plane, and coupled to the second connecting element;

wherein the radiating portions located in the first, the second, and the third planes transmit and/or receive signals in a first frequency band; the radiating portion located in the third plane is utilized to adjust transmissions and/or receptions in the first frequency band; the radiating portions located in the first, the second, and the fourth planes transmit and/or receive signals in a second frequency band; the radiating portion located in the fourth plane is utilized to adjust transmissions and/or receptions in the second frequency band; a first angle between the first and the second planes, a second angle between the second and the third planes, and a third angle between the second and the fourth planes range between 80 degrees to 100 degrees; the third plane and the fourth plane are respectively located at two opposite ends of the second plane; and the third plane is arranged without overlapping both the first plane and the fourth plane.

8. The wireless communication device of claim 7, further comprising one or more supporting elements extending from at least one of the radiating body, the shorting element, and the feeding element and abutting the substrate for supporting the dual-band antenna.

9. The wireless communication device of claim 8, wherein a fourth angle between the supporting element and at least one of the radiating body, the shorting element, and the feeding element ranges between 80 degrees to 100 degrees.

10. The wireless communication device of claim 7, wherein the first plane and the third plane are substantially in the same plane.

11. The wireless communication device of claim 7, wherein a distance between the shorting element and the feeding element ranges between 0.5 mm to 6 mm.

12. The wireless communication device of claim 7, wherein a distance between the shorting element and the substrate ranges between 1.5 mm to 4.5 mm.

13. The wireless communication device of claim 7, wherein the radiating body comprises:

a first radiating portion located in the first plane;

a second radiating portion located in the second plane;

a third radiating portion located in the third plane; and a fourth radiating portion located in the fourth plane.

14. The wireless communication device of claim 13, wherein a distance between the first radiating portion and the substrate ranges between 0.8 mm to 4.5 mm.

15. A dual-band antenna, comprising:

a radiating body, comprising a first radiating means located in a first plane, a second radiating means located in a second plane, a third radiating means located in a third plane, and a fourth radiating means located in a fourth plane, wherein the first, the second, and the third radiating means are utilized for transmitting and/or receiving signals in a first frequency band and the first, the second, the fourth radiating means are utilized for transmitting and/or receiving signals in a second frequency band;

a shorting means extending from the radiating body and located in the first plane for coupling to a ground; and a feeding means extending from the radiating body and located in the first plane for coupling to an external component;

wherein a first angle between the first and the second planes, a second angle between the second and the third planes, and a third angle between the second and the fourth planes range between 80 degrees to 100 degrees; the third radiating means located in the third plane is utilized to adjust transmissions and/or receptions in the first frequency band; the fourth radiating means located in the fourth plane is utilized to adjust transmissions and/or receptions in the second frequency band; the third plane and the fourth plane are respectively located at two opposite ends of the second plane; and the third plane is arranged without overlapping both the first plane and the fourth plane.

16. The dual-band antenna of claim 15, further comprising one or more supporting means extending from at least one of the radiating body, the shorting means, and the feeding means.

17. The dual-band antenna of claim 16, a fourth angle between the supporting means and at least one of the radiating body, the shorting means, and the feeding means ranges between 80 degrees to 100 degrees.

18. The dual-band antenna of claim 15, wherein the first plane and the third plane are substantially in the same plane.

19. The dual-band antenna of claim 15, wherein a distance between the shorting means and the feeding means ranges between 0.5 mm to 6 mm.

* * * * *